United States Patent [19]

Grossi

[11] 4,450,668

[45] May 29, 1984

[54] AUTOMATIC PACKAGING MACHINE

[75] Inventor: Renzo Grossi, Milan, Italy

[73] Assignees: Dario Manuli S.p.A., S. Pietro Mosezzo; F.I.S., s.r.l. Macchinari Per Imballaggi, Milan, both of Italy; a part interest

[21] Appl. No.: 270,691

[22] Filed: Jun. 4, 1981

[51] Int. Cl.[3] ..... B65B 11/04

[52] U.S. Cl. ..... 53/176; 53/449; 53/556; 53/587; 53/211

[58] Field of Search ..... 53/441, 449, 176, 397, 53/556, 557, 580, 587, 588, 211

[56] References Cited

U.S. PATENT DOCUMENTS

| | | | |
|---|---|---|---|
| 2,994,998 | 8/1961 | Zuercher | 53/580 |
| 3,640,048 | 2/1972 | Telnick | 53/557 X |
| 3,672,116 | 6/1972 | Ingmarson | 53/580 X |
| 3,893,279 | 7/1975 | Bostrom | 53/176 X |
| 3,896,604 | 7/1975 | Marantz | 53/176 |
| 3,910,005 | 10/1975 | Thimon | 53/397 |
| 4,044,529 | 8/1977 | Telnick | 53/556 X |
| 4,077,179 | 3/1978 | Lancaser | 53/556 X |

FOREIGN PATENT DOCUMENTS

| | | | |
|---|---|---|---|
| 2448720 | 4/1975 | Fed. Rep. of Germany | 53/449 |
| 2057386 | 4/1981 | United Kingdom | 53/580 |

*Primary Examiner*—John Sipos

*Attorney, Agent, or Firm*—Allison C. Collard; Thomas M. Galgano

[57] ABSTRACT

An automatic packaging machine comprises a slide vertically sliding along a stationary load bearing column and provided with horizontal rails wherealong a power driven carriage is movable carrying a packaging foil web supply device for laying a top horizontal sheet onto a parcel or pile to be packaged.

9 Claims, 8 Drawing Figures

AUTOMATIC PACKAGING MACHINE

BACKGROUND OF THE INVENTION

This invention relates to an automatic machine and method for packaging parcels or stacked objects in a wrapper.

Known are machines for wrapping individual objects or piled objects. The machine described in the Italian Patent application No. 23,073 A/78 provides a common rotating platform and lapping tape or web supply means for wrapping an object being rotated on the platform. To complete the package, over the object's top and base portions there is laid, either manually or through suitable means, a packaging material sheet, with its edges folded onto the sides of the object, in separate steps, thereafter the sides of the object are wrapped taking care to cover and secure by the end turns of the tape, the sheets laid onto the top and base.

No machine or system, either of the automatic or semiautomatic types, is known which affords the possibility of mechanically performing all of the packaging operations, without involving manual packaging steps, and without requiring the article being packaged to be transferred to several stations.

This being the status of the packaging art, the task of this invention is to remove the above shortcomings in the packaging industry by providing an automatic packaging machine and packaging method, which produce a package of the type specified above through the sole utilization of the instant machine and without involving any further operations at other package processing stations.

SUMMARY OF THE INVENTION

A particular task of this invention is therefore to provide a packaging machine of the described type including additional operative units adapted to automatically lay a top or bottom packaging foil onto the parcel sequentially with the wrapping of the sides of the parcel.

According to one aspect of this invention, there is provided an automatic packaging machine which comprises a packaging foil web first supply means for wrapping the sides of the object to be packaged, a power driven turning table adapted for receiving the object to be packaged thereon, means releasably holding the object to be packaged in position on the turning table, and a load-bearing columnar frame, characterized in that it further comprises a slide arranged for sliding vertically along said columnar frame, said slide being provided with substantially horizontal rails, extending substantially parallel to said table, a power driven carriage movable along said rails, a cantilevered frame carried by said carriage and whereon a packaging foil web second supply means is provided which is operative to lay a top or bottom horizontal sheet onto the object to be packaged in a sequentially coordinated manner with the packaging foil web first supply means.

BRIEF DESCRIPTION OF THE DRAWINGS

The features, mode of operation and advantages of the invention will become more apparent from the following detailed description of a presently preferred embodiment thereof, with reference to the accompanying drawings, where.

DESCRIPTION OF THE PREFERRED EMBODIMENTS

Figure 1:
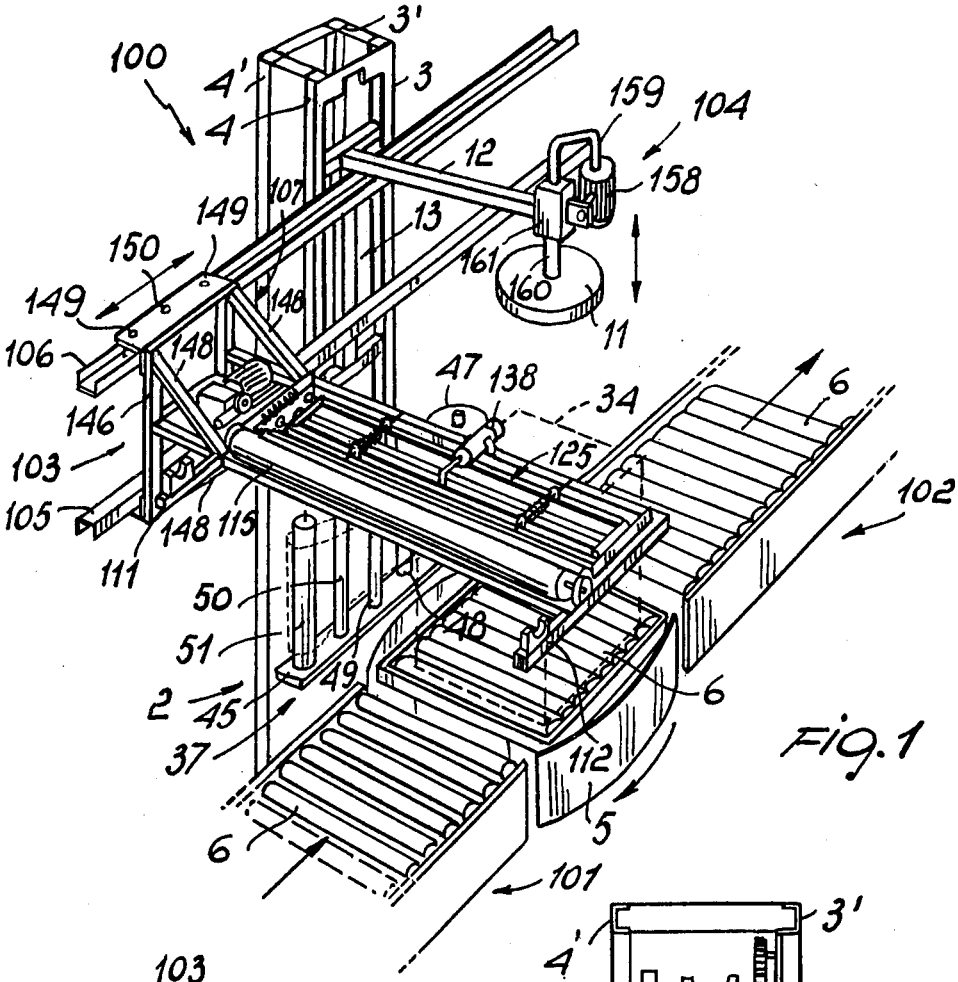
FIG. 1 is a perspective view of the packaging machine according to the invention.

Some of the component parts of the machine are similar to analogous component parts of the machine described in the above mentioned published Italian Patent application No. 23,073 A/78 and these component parts have been indicated with reference numerals less than 100, and have been only cursorily described but sufficiently for the purpose of this invention, while the other more fully described component parts have been indicated with a reference numeral from 100 onwards. The reference numeral 100 designates generally the machine according to this invention. The frame 2 has a base portion which comprises a platform 5 in the form of a turning or rotating table assembly, conveyor rollers 6, and a columnar structure including front uprights 3 and 4, and rear uprights 3' and 4'. A parcel 34 to be packaged, indicated with dotted lines, is placed onto the platform 5. Along the uprights 3 and 4, there is mounted for sliding movement a first carriage or slide 13 having a cantilevered arm 12 which carries a pressure disk or lid 11. A second carriage 37, the base 45 whereof is visible in the drawing, carries for sliding movement along the uprights 3 and 4 the wrapping web or tape supply device or means, the roll 47 and transmission rollers 48–51 whereof are visible in the drawing. Also shown are an inlet conveying deck 101 and outlet or discharge conveying deck 102, also equipped with power driven rollers 6.

Figure 2:
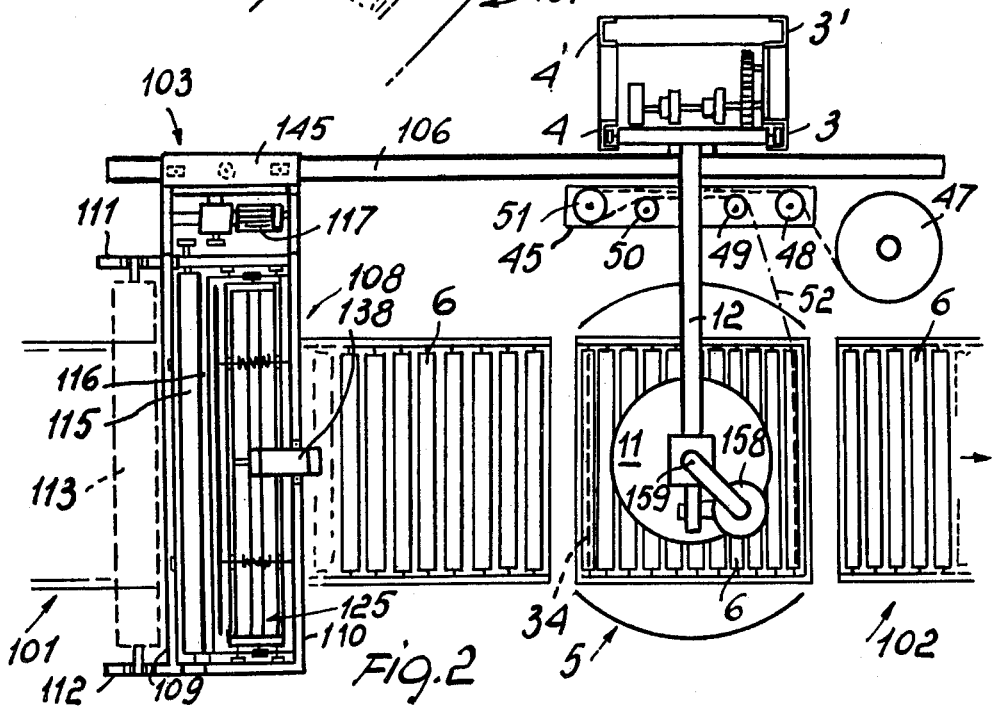
FIG. 2 is a plan view of that same machine.

The novel parts of the machine or system 100 according to the invention include a second packaging foil web or tape supply unit 103 and a device 104 for displacing the lid 11 vertically. The entire unit 103, which will be now described with reference, in particular, to FIGS. 1 and 2, is transported vertically by the carriage 13, which is of a suitably strengthened and possibly lengthened type as compared to the one described in the above Italian application. The drive for this carriage is also of the type described in the above Italian application, the only difference residing in the installation of a counterweight and related transmission, not shown, to match the increased weight.

Also included in the foil web supply unit 103 are two parallel rails 105 and 106, located in the same vertical plane and both carried by the carriage 13, which extend coplanar and have projections set crosswise thereto, as is clearly shown in FIG. 1. Along said rails, a power driven overhead or suspended carriage 107 is caused to travel, which extends vertically and wherefrom a flat frame 108 is cantilevered in the form of a horizontal bracket which is defined by two longitudinal stringers 109 and 110 and cross-members 111 and 112 set to project from one side to support a long roll 113 of packaging plastics sheets or film or foil between the projecting ends thereof. To feed the packaging film 114 (FIG.

Figure 2A:
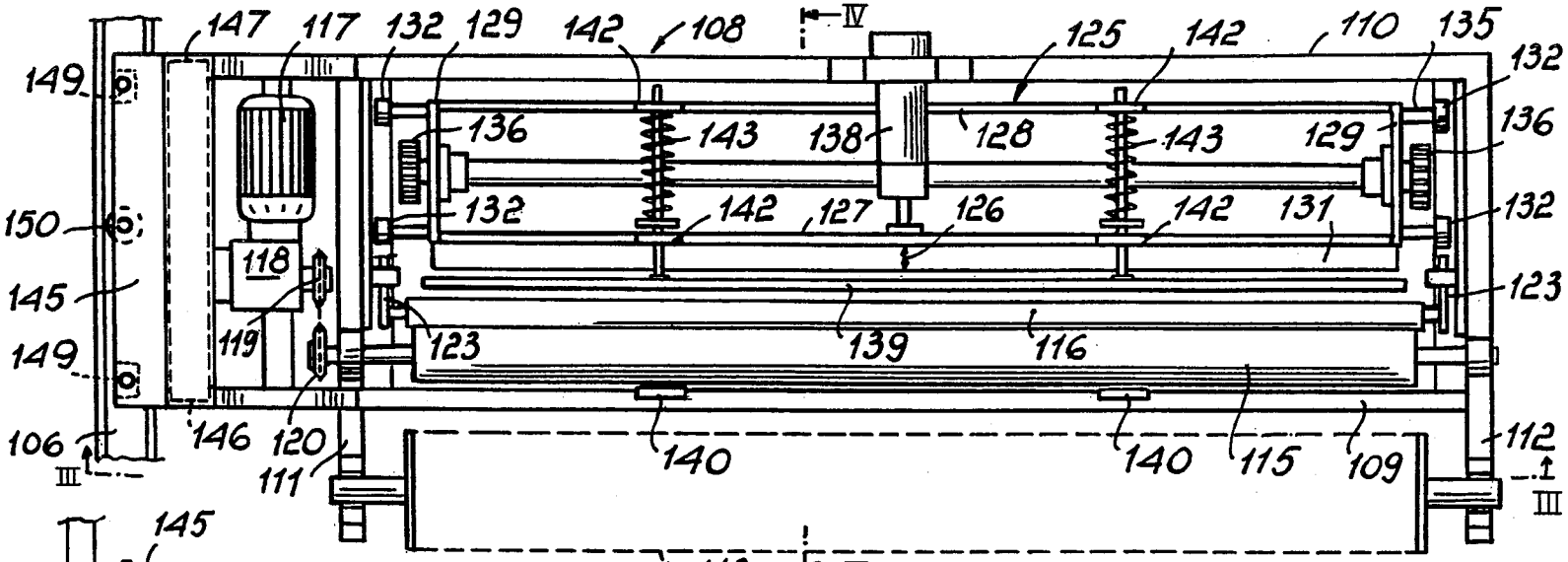
FIG. 2A is an enlarged scale detail view of FIG. 2, with parts removed for clarity.
Figure 3:
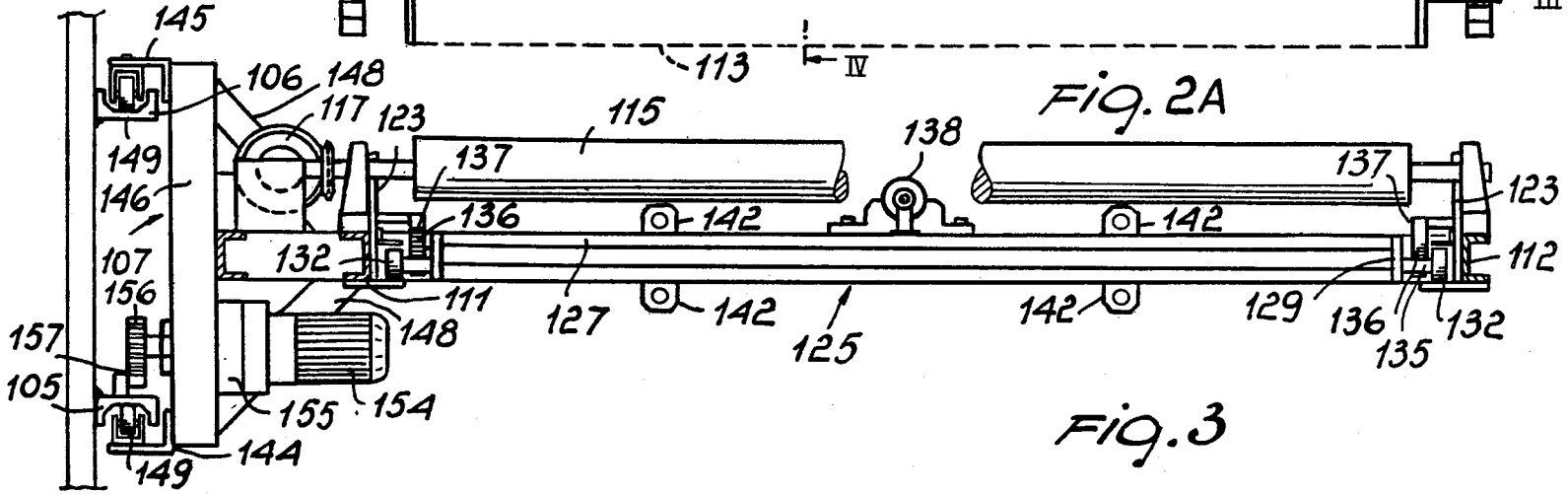
FIG. 3 is a partial side elevation view taken along the line III of FIG. 2A, with parts removed for clarity.
Figure 4:
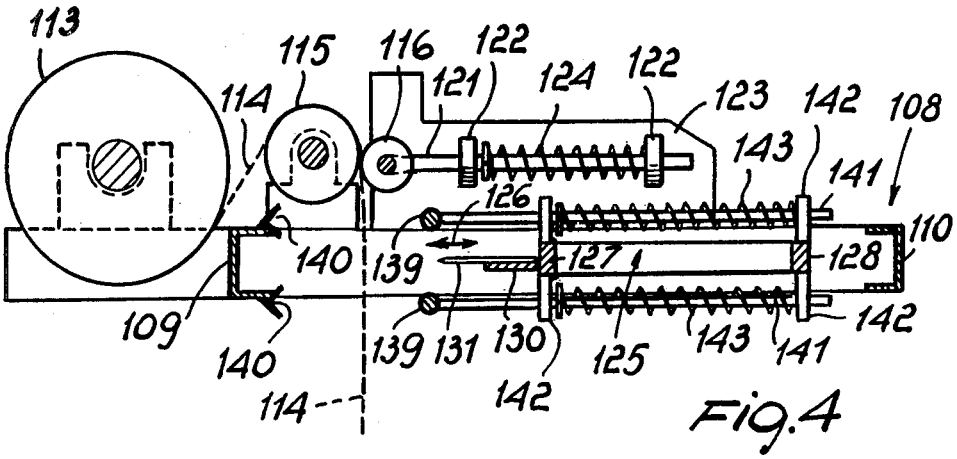
FIG. 4 is a sectional view taken along the line IV—IV of FIG. 2A.
Figure 5:
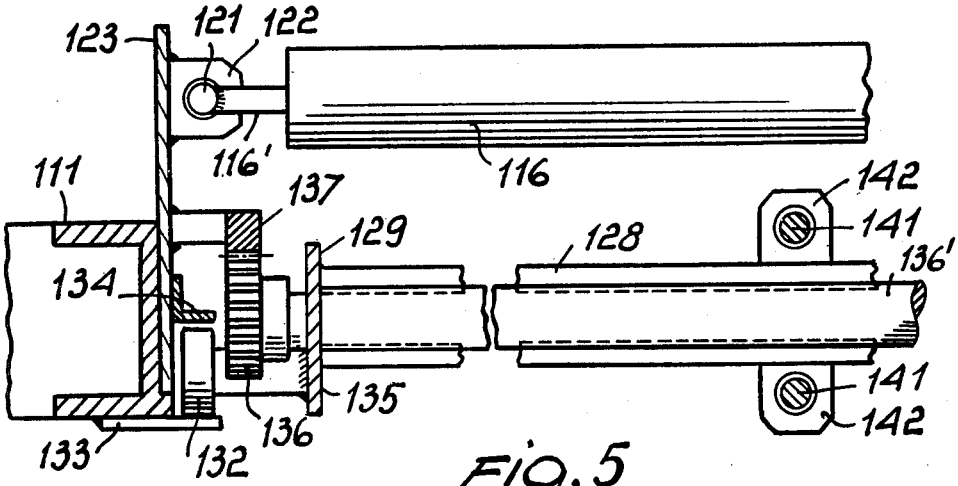
FIG. 5 is a detail view, with parts cut away and to an enlarged scale, of FIG. 3.

4) from the roll 113, there are mounted between the cross-members 111 and 112 an additional driving unwinding roller 115 and an idle roller 116 set to rotate by frictional engagement with the driving roller 115, which presses onto the driving roller the film 114 from the roll 113, thereby the film is pulled in the nip between the two rollers, unwound and dropped downwards, as is more clearly shown in FIGS. 2A and 4. For driving the unwinding roller 115, there is installed on the frame 108 an electric motor 117 with a worm screw type of reduction gear 118, which rotates the roller through a gear pair 119, 120. The pressure roller 116 is supported, and urged against the unwinding roller 115, by rods 121 (FIG. 4) connected to the carrying shaft 116' on which the roller 116 is rotatably arranged (FIG. 5). The rods 121 are located one at each end of the shaft 116' and are slidable each in two sleeve guides 122 which are attached to a plate 123, in turn welded to the cross-member 111 of the frame 108, respectively 112. The biasing force is supplied by a spring 124 mounted to rest on the rod and the farthermost sleeve 122. On the frame 108, there is further mounted an automatic control cutter for cutting to size the film 114 while lapped over the parcel 34 to be packaged. This device is more clearly shown in FIGS. 2A, 3 and 4, as well as in the enlarged detail view of FIG. 5. It comprises a small frame 125 of rectangular contour shape, which is contained with its parallel sides in the frame 108, set to travel slidably in the directions of the double arrowhead 126 (FIGS. 2A and 4) between the longitudinal stringers 109 and 110. The frame 125 has its longer sides, i.e. the front side 127 and rear side 128, made from a boxed profile section and joined by shorter sides formed from two flat bars 129.

From the front side 127, a knife holder 130 (FIG. 4) with knife 131 having substantially the same length as the small frame 125, and similarly laid horizontally, protrudes with its cutting edge facing the falling film 114. The small frame 125 moving guillotine-like in the frame 108, is mounted on four wheels 132, two on each short side, which roll along rails comprising a runway 133 and an upper edge 134 (FIG. 5). The wheels support each a respective flat bar 129 through a pin 135 projecting therefrom. However, to ensure positive movability of the small frame and knife at a high rate without jamming, the guides are not considered to be adequate by themselves. Thus, a pinion and rack transmission 136, 137 is provided on both sides, with a shaft 136' holding together the two pinion gears 136 on both sides. The two rack sections 137 are attached to the two plates 123, respectively to the two sides thereof (FIGS. 2A and 5). This rigid transmission ensures a positively parallel translation of the small frame 125, inasmuch as any possible displacement on one side is reproduced faithfully on the other side owing to the parallel interconnection of the two racks. Thus, a reliable kinematic parallelism is achieved which allows normal backlash in the gear coupling and which parallelism would be extremely difficult to maintain with prismatic or slideway guides, and only to be achieved at the expense of high-precision and prohibitively expensive machining processes. The translatory movement of the carriage is imparted through a pressure fluid operated cylinder 138 which is attached to the longitudinal stringer 110, at the centerline of the small frame 125 and which acts in a crosswise direction thereto. In order to stop the film 114 at the cutting time, the frame is provided with frontally mounted cylindrical rods 139 acting like bumpers or feelers, and parallel to the long side thereof, directly in front of the knife 131, located in the same vertical plane (FIG. 4). In moving along with the small frame, the two rods 139 engage with two respective stop seats 140 of "V" shape, extending parallel to the rods 139 and located on respectively facing edges of the U-like longitudinal stringer 109. Against said "V" stop seats, the two cylindrical rods lock the sheet 114 with spring action. To allow the knife to move further forward and perform the cut, the two rods 139 are supported telescopically by the small frame. More specifically, each rod 139 is carried as a bumper in projecting tubes 141 which are set to withdraw telescopically into two spaced apart lugs 142, which are bored and set to protrude from the sectional members 127 and 128 respectively of the small frame 125. Each tube 141 is slidable in the direction of the arrowhead 126 through the bores in the tabs, but moves rigid with the small frame, until the studs are stopped by the "V" seats, since a spring 143 for each tube engages the tube itself and urges it against the lug 142 on the opposite side to the knife 131. Thus, while the small frame 125 is moved toward the film 114 to be cut, it holds the latter securely pressed with the cylindrical rods 139 in the opposite "V" seats 140 and additionally creates a stretching effect on the film which favours a quick cutting action as the knife cutting edge meets the film 114.

Figure 6:
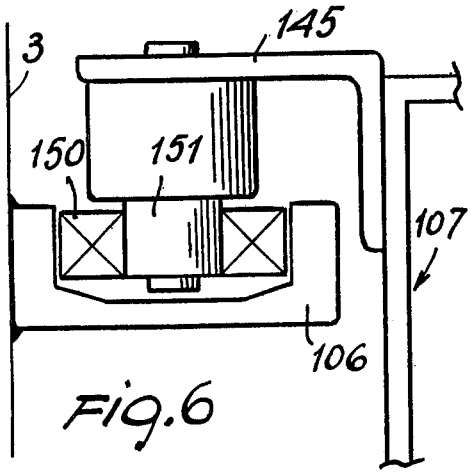
FIGS. 6 and 7 are further detail views of FIG. 3.
Figure 7:
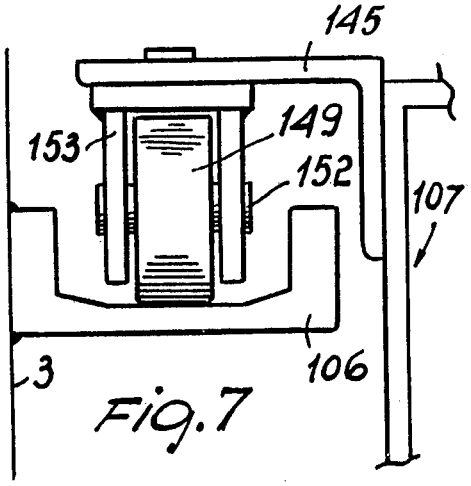

Still to be explained is how the carriage 107 of the frame 108 is carried slidably on the rails 105 and 106 and how it is moved. The carriage proper is composed of a frame comprising two wheel-carrying angle members 144 and 145 (FIG. 3) and two connecting beams 146 and 147 from which the longitudinal stringers 109 and 110 respectively extend squarely, the bracket construction being further strengthened at the joints by oblique gussets 148. The angle members 144 and 145 support the carriage slidably in the rails 105 and 106 by means of two types of bearing wheel devices 149 and 150: the load-bearing wheel devices 149 having their axes horizontal and supporting the vertically acting weight carried mainly by the U-like rails 106 and transmitted thereto mainly by the top member 145, and the thrust wheel devices 150 having their axes vertical, which oppose the moment, i.e. the horizontally acting forces and transmitted by the member 145 onto the rail 106 in one direction and by the member 144 onto the inverted "U" rail 105 in the other horizontal direction. The detail views of FIGS. 6 and 7 show in an enlarged scale these bearing wheel devices. The wheels 150 are mounted to a pivot pin 151 which is rigid with the angle member 144 or 145, respectively, the wheels 149 being mounted to a pivot pin 152 carried by a bracket 153 attached as by welding to the angle member 144 or 145. Preferably two wheel devices 149 and therebetween one wheel device 150 cooperate with the upper rail 106 (FIG. 1, 2A) and two wheel devices 150 cooperate with the lower rail 105. FIG. 3 shows a third wheel device 149 cooperating with the lower rail 105, even if the two wheel devices 150 may be sufficient for the cooperation, not shown, with the lower rail 105. The movement is imparted to the carriage 107 by an electric motor 154 (FIG. 3) installed on the carriage, through a reduction gear 155, which meshes with a drive pinion gear 156 with a rack 157 secured to the rail 105 over its entire length.

The carriage 13, which moves in a vertical direction, carries the arm 12 supporting the lid 11, and a device 104 for displacing the lid vertically.

In fact, the carriage 13 is destined first to raise the upper packaging sheet supply system to a suitable height for the parcel to be packaged. In doing so it moves the arm 12 therealong, and thereby also locates the lid 11 to an operating distance, which lid is not only adjusted for pressing on the parcel after the latter has been wrapped in the lateral foil web 52 (FIG. 2), but is also to be raised for allowing the frame 108 with the sheet 114 to pass therebetween. For this vertical movement of the lid 11, there is provided a pressure-fluid operated cylinder 158 (FIG. 1), attached to the arm 12, the rod 159 whereof is rigid with a parallel shaft 160, set to slide in a sleeve 161 at the end of the arm 12, which supports the lid 11. By extending the rod 159, the lid 11 is raised, and vice versa.

In describing the individual components, their shapes and functions, their combined mode of operation have also been explained, such that the coordinated overall operation of the machine can now be described along with the method it implements.

After having adjusted the height of the carriage 13 and consequently of the rails 105 and 106 depending on the height of the parcel 34, the latter is delivered onto the platform 5 by a feeder 101, where it is wrapped in the lateral foil web 52, from bottom to top, while it is caused to turn or rotate together with the platform in the manner described in the above mentioned Italian Patent application. Upon completion of a wrapping layer, the web is cut, the lid 11 raised, the frame 108 caused to move horizontally above the parcel to lay a lapping top or upper sheet thereon. For the purpose the movement of the frame 108 is started while having a flap of sheet 114 barely protruding downwardly from the rollers 115 and 116, as it has been previously cut in an appropriate manner at the end of the previous cycle. At a programmed time, said rollers begin to unwind the foil or film, such that a measured sinking length thereof extends downwardly beyond the level of an upper corner of the parcel, thereby to meet the corresponding vertical side of the parcel while the frame 108 is horizontally moved past the parcel's top and thereby leaving on such vertical side of the parcel an edge or flap which is subsequently folded over the corner on the top side of the parcel. In fact, the timed or synchronized unwinding causes the film to be deposited onto, and lap the top surface of the parcel until it is fully covered thereby. Now, the horizontal movement of the carriage 107 is controllably stopped in a position where a portion or flap of the foil extends beyond the rear top corner of the parcel. The cutter is then moved with the knife 131, as carried in the small frame 125, forward to cut the film. The automated operation is adjusted such that said portion or flap of the film extending beyond the rear top corner of the parcel is let down on the opposite vertical side; the suitable tackiness of the sheet causes it to adhere to the parcel which it is lapping. Obviously, the width of the sheet is so selected as to cause a desired edge of the sheet to lap the other two vertical sides as well, such as to provide complete covering. If desired, the carriage 107 may be held in the last reached position at the rear side of the parcel or caused to move rearwards. Then, the second helical wrapping is carried out, this time preferably from top to bottom, with the foil web 52, to exactly cover or overlap the edges of the upper sheet, which are thus sandwiched between the first and second wrapping. At each wrapping, the device 104 will lower the lid 11 such as to keep the parcel aligned as it is rotated within reach of the web 52. Upon completion of the second wrapping, which may be a single coil forming the upper wrapper, the packaging is also completed and the parcel is discharged by the conveyor 102.

A perfect synchronization or timing of the events can be accomplished through any conventional means, using sensors and detectors, e.g. of an optical nature, or more simply travel limit switches, or even adjustable centralized timers. In all cases, the foregoing description, in conjunction with the illustration provided by the drawings, has shown how complete automation has been achieved with reliable mechanical means and easily synchronizable movements, in a compact and functional arrangement. This constitutes the main advantage of the machine and the material achievement of the invention's objects. Other important advantages are afforded by the solutions provided to various interconnected problems, which had no straightforward solution in conventional apparatus.

By combining on a single carriage the arm 12 and rails 105, 106, it becomes possible to adapt two basic devices to the wide range of variation in the parcel or pile sizes, e.g. up to two or three meters high, in actual practice having no limitations as required by their market applications. The arrangement of the wheels 149 and 150 onto the carriage 107 brilliantly solves the problem of attaining a smooth translatory movement, under considerable weight and combined moments, while affording the possibility of adopting the convenient rack-and-pinion type of drive. The long cantilevered frame, designed flat to easily move through the gap between the lid 11 and the parcel, enjoys a certain springy action, which is not disturbing, thanks to the features provided, and permits a lightweight and compact structure. The rigid translation of the knife, without the risk of binding or jamming, with knife sizes which may exceed two meters in length, has been achieved, in a most economical manner, by providing a twin rack 137 type of drive and guiding system, which, similar to a transducer, keeps all micro-movements on one side equalized with those on the other side.

This particular method has the advantage of presenting to the parcel partly overlapping web turns, similar to mutually penetrating inverted V's, which have their contacting portions exposed to rain water diverging downwardly, like the overlapping edges of the upper sheet. Thus, in a quick manner and one requiring but a minimum of material, a water impervious wrapping has been ensured by an arrangement which fully utilizes the water imperviousness afforded by the film employed.

The apparatus described hereinabove also affords the possibility of performing partly modified packaging cycles, e.g. lay an upper sheet prior to the first wrapping, or even apply an upper web, wrap from top to bottom, turn the parcel over, lay an upper web on the other parcel basis, and again perform the second wrapping from top to bottom.

The apparatus lends itself to several different packaging procedures, as will be recognized by those skilled in this art. In addition thereto, the very basic conception of this apparatus may be implemented in a different manner through equivalent mechanical features, without departing from the scope of the present invention.

I claim:

1. An automatic packaging machine including a first packaging mechanism for helically wrapping the upright sides of the objects to be packaged by means of at least a first sheet and a second packaging mechanism for the installation of at least one separate overcapping sheet on a least one top or bottom end of the object to be packaged, said first packaging mechanism comprising a vertically movable frame, supply means for said first sheet mounted on said frame, means for vertically moving said frame, a power driven turntable for receiving the object to be packaged, a vertically movable lid member for pressing said object to be packaged on the turntable, a load-bearing columnar frame and a slide vertically sliding along the columnar frame, means for vertically moving said slide wherein said lid member is supported on said slide and intermediate power driven supporting means are provided between said slide and said lid member for controlled lowering and raising of said lid member independently from the lowering and raising of said slide, said second packaging mechanism comprising a carriage movable along rails horizontally positioned on said slide and extending parallel to said turntable, means for horizontally driving said carriage, a cantilevered frame carried on said carriage, at least a bobbin of packaging sheet for said overcapping sheet installation which is supported by said cantilevered frame and movable by said driven carriage together with said cantilevered frame from a first end position offset from said lid member to a second end position oppositely offset from said lid member, and means for feeding said overcapping sheet onto the top of the object to be packaged so that overlapping edges of said sheet are formed extending over the upright sides of the object thereby allowing said lid member to be lowered onto the top of the object wrapped in a first lateral wrapping and the top of the overcapping sheet so that the overlapping edges of said overcapping sheet may be sandwiched between said first and a subsequent second lateral wrapping by said first packaging mechanism.

2. The automatic packaging machine as defined in claim 1, wherein said means for feeding said overcapping sheet onto the object to be packaged includes a power driven, unwinding roller and an idle roller supported by said cantilevered frame extending substantially parallel to each other and to said bobbin, said idle roller cooperating with said unwinding roller and frictionally entrained thereby to pull out and controllably drop from the nip the packaging sheet from said bobbin.

3. The automatic packaging machine as defined in claim 1, which further includes a web cutter device in said second packaging mechanism.

4. The automatic packaging machine as defined in claim 3, wherein said cutter device includes a supporting frame set for translatory movement in said cantilevered frame having a knife facing the web, sheet locking members effective to lock said sheet during the cutting thereof, and activating means for activating said cutter device.

5. The automatic packaging machine as defined in claim 4, wherein said power driven carriage moves on wheels and is guided by a dual drive on either side thereof having two pinion gears fixedly mounted on a shaft therebetween, each pinion gear meshing with a rack fixed to said frame.

6. The automatic packaging machine as defined in claim 4, wherein said activating means includes a pressure fluid operated cylinder.

7. The automatic packaging machine as defined in claim 1, wherein said power-driven carriage is supported on said rails by means of horizontal axis wheels arranged to bear the load thereof and vertical axis wheels taking up the moment applied to said carriage.

8. The automatic packaging machine as defined in claim 7, wherein said means for driving said carriage comprises an electric motor driving, through a reduction gear, a pinion gear meshing with a rack fixed to one of the rails whereon said carriage moves.

9. The automatic packaging machine as defined in claim 1, wherein said intermediate power driven supporting means for said lid member comprises a shaft on which said lid member is mounted, a sleeve member in which said shaft is slidably supported on an arm rigid with said slide, and a pressure fluid operated cylinder supported on said arm and having a piston rod rigid with said shaft.

* * * * *